US006073720A

United States Patent [19]

Vanderlinden

[11] Patent Number: 6,073,720

[45] Date of Patent: Jun. 13, 2000

[54] SINGLE ENGINE STREET CLEANING VEHICLE

[76] Inventor: Roger P. Vanderlinden, 73 Sherman Ave. S., Hamilton, Canada

[21] Appl. No.: 09/159,565

[22] Filed: Sep. 24, 1998

[51] Int. Cl.[7] ..... F15B 7/00

[52] U.S. Cl. ..... 180/307; 74/665 L; 475/329; 180/305

[58] Field of Search ..... 180/305, 306, 180/307, 53.2, 53.4; 74/665 L, 732.1; 475/72, 83, 84, 329

[56] References Cited

U.S. PATENT DOCUMENTS

| | | | |
|---|---|---|---|
| 3,636,580 | 1/1972 | Woedwortz | 15/84 |
| 4,355,509 | 10/1982 | Falkerson et al. | 180/307 |
| 5,649,606 | 7/1997 | Beberhes et al. | 180/307 |
| 5,810,106 | 9/1998 | McCoy | 180/307 |

FOREIGN PATENT DOCUMENTS

| | | | |
|---|---|---|---|
| 38772 | 10/1981 | European Pat. Off. | 475/329 |
| 937857 | 6/1982 | U.S.S.R. | 475/329 |

*Primary Examiner*—Richard M. Camby

[57] ABSTRACT

A street cleaning vehicle comprises a street cleaning apparatus, and an engine having a mechanical power output. A differential and axle assembly has a first drive input drivable in a first phase by the mechanical power output of the engine through a mechanical coupling and a second drive input drivable in a second phase by the mechanical power output of the engine through a hydraulic power system, and drive axles drivable by a selected one of the first drive input and the second drive input, so as to propel the street cleaning vehicle. A selectably operable switching mechanism is included to effect a selected one of the first and second phases.

13 Claims, 5 Drawing Sheets

SINGLE ENGINE STREET CLEANING VEHICLE

FIELD OF THE INVENTION

The present invention relates to street cleaning vehicles and the like and more particularly to single engine street cleaning vehicles, specifically to those manufactured onto an existing truck chassis.

BACKGROUND OF THE INVENTION

Conventional street cleaning vehicles have been known for several decades and typically employ either one or more types of cleaning apparata to capture dirt and debris and deposit it into a hopper. Such conventional cleaning apparata include mechanical systems employing sweeping brushes, and air suctioning systems, both vacuum and regenerative types.

Street cleaning vehicles are typically driven on roads between job sites at normal roadway speeds of perhaps thirty to fifty miles per hour. However, during use at a job site, street cleaning vehicles must be driven at very slow speeds of perhaps about one to five miles per hour. In heavy dirt and debris, typically the travel speed is about one mile per hour, since maximum rate at which dirt and debris can be effectively cleaned from a paved surface.

Driving street cleaning vehicles at such slow speeds presents a very considerable and significant problem. The vehicle's powerplant, typically a diesel engine or a conventional gasoline engine must always run at about 1500 to 2000 r.p.m., or even more, in order to produce the necessary horsepower to power the cleaning apparatus. However, at this engine speed, even employing a special transmission having a very low first gear, a street cleaning vehicle would travel at a minimum speed of about five m.p.h., which is significantly faster than the required one mile per hour for cleaning heavy debris. Accordingly, it is common to use the street cleaning vehicle's brakes while cleaning heavy debris, in order to achieve the required low speed. However, since the street cleaning vehicle is in very low gear, the forward driving force is extremely powerful, and accordingly, brakes tend to wear out extremely quickly. Further, this can be dangerous as it is difficult to actually come to a stop quickly.

One simple possible solution to this above described problem is use a drive line reduction transmission in line with the conventional transmission in order to achieve a very low overall gear ratio. Athey Products Corporation of Wake Forest, N.C., U.S.A., manufacturers of the Mobil Sweeper line, produces such a street cleaning vehicle. It has been found however, that this street cleaning vehicle still requires braking to run slowly enough in heavy debris, and is extremely difficult to bring to a full stop. Further, drive line reduction transmissions are prohibitively expensive.

In order to overcome the dichotomy of providing sufficient power to drive the cleaning apparatus, while travelling at a sufficiently slow speed, many street cleaning vehicles use a main internal combustion engine and an auxiliary internal combustion engine. The main internal combustion engine is used with a conventional transmission to drive the street cleaning vehicle during travel between job sites and while performing its cleaning operation. The auxiliary internal combustion engine is used to power the cleaning apparatus to achieve varying and sufficient broom speeds while not affecting the vehicle's travel speed. However, such street cleaning vehicles still have the problem of not being able to travel slowly enough, especially during heavy dirt and debris removal where extremely slow speeds are required, since a conventional transmission is used. Moreover, the inclusion of a second internal combustion engine prohibitively increases the cost of the street cleaning vehicle, maintenance costs, and fuel costs.

Also known are specially designed hydraulically driven street cleaning vehicles that use a single internal combustion engine to power various hydraulic drive systems. A hydraulic variable displacement pump and a first hydraulic drive motor are used to drive the vehicle during travel between job sites and while performing its cleaning operation. A hydraulic gear pump and a second hydraulic drive motor are used to drive cleaning apparatus. Accordingly, it is possible to vary the travelling speed of the street cleaning vehicle during dirt and debris removal without affecting the power delivered to the cleaning apparatus. However, such hydraulically driven street cleaning vehicles are not built on a separate truck chassis and resultingly have a low top speed, tend to have extremely poor higher speed handling and braking characteristics, be mechanically unreliable, have high maintenance costs, and therefore are not preferred in many circumstances.

Another approach to the above described problem of providing sufficient horsepower to the cleaning apparatus while driving the street cleaning vehicle at very slow speeds is to directly drive the rear differential through a conventional transmission, and to hydraulically power the cleaning apparatus. One example of such a street cleaning vehicle is known as the "Broom Bear" owned by Elgin Sweeper Co. of Elgin, Ill. A variable displacement hydraulic piston pump is driven by the engine's driveshaft and powers the cleaning apparatus. Accordingly, the power available to the cleaning apparatus is controllable. However, the inherent problem with this design is that the engine speed must remain above about 1500 r.p.m. in order to produce sufficient horsepower to drive the vehicle and power the cleaning apparatus. Accordingly, the vehicle cannot be driven slowly enough in heavy debris without riding the brakes.

In an attempt to solve the above discussed problems associated with various types of street cleaning vehicles, Johnston Sweeper Co. of Pomona, Calif., has introduced a single internal combustion engine street cleaning vehicle built on a commercial truck chassis. This street cleaning vehicle employs a diesel engine driving a conventional transmission and rear differential arrangement. Additionally, a switching gearbox is installed in-line between the transmission and the conventional single input rear differential. For travel between job sites, the internal combustion engine drives the rear wheels through the transmission, the main "straight-through" input of the switching gearbox, and rear differential, essentially as if the switching gearbox had not replaced the conventional axle. A power take-off unit is operatively mounted on the transmission, with a hydraulic variable displacement pump and a hydraulic gear pump driven by the power take-off unit. The hydraulic variable displacement pump powers a first hydraulic drive motor operatively coupled to the auxiliary input of the switching gearbox, as opposed to being coupled to the main "straight-through" input. During cleaning, the switching gearbox is driven by the first hydraulic drive motor, not directly by the vehicle's engine through the conventional driveshaft. In any event, the output of the switching gearbox directly drives the one input of the rear differential.

Even through limited use, it has become readily apparent that this single internal combustion engine street cleaning vehicle has not been gaining market acceptance, mainly due to the fact that switching gear boxes tend to be prohibitively expensive, representing a significant cost relative to the cost of the entire street cleaning vehicle, which is highly undesirable.

It is an object of the present invention to provide a single internal combustion engine street cleaning vehicle.

It is another object of the present invention to provide a single internal combustion engine street cleaning vehicle that has a short wheelbase.

It is yet another object of the present invention to provide a single internal combustion engine street cleaning vehicle that can be driven at appropriately slow speeds while cleaning heavy debris and make available sufficient power for the cleaning apparatus.

It is yet another object of the present invention to provide a single internal combustion engine street cleaning vehicle that is inherently less expensive to produce than prior art models.

SUMMARY OF THE INVENTION

In accordance with the foregoing and with one aspect of the present invention, there is provided a novel street cleaning vehicle comprising a street cleaning apparatus, and an engine having a mechanical power output. A differential and axle assembly has a first drive input drivable in a first phase by the mechanical power output of the engine through a mechanical coupling means and a second drive input drivable in a second phase by the mechanical power output of the engine through a hydraulic power means, and drive axles drivable by a selected one of the first drive input and the second drive input, so as to propel the street cleaning vehicle. A selectably operable switching means is included to effect a selected one of the first and second phases.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the single engine street cleaning vehicle according to the present invention, as to the present invention's structure, organization, and use, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
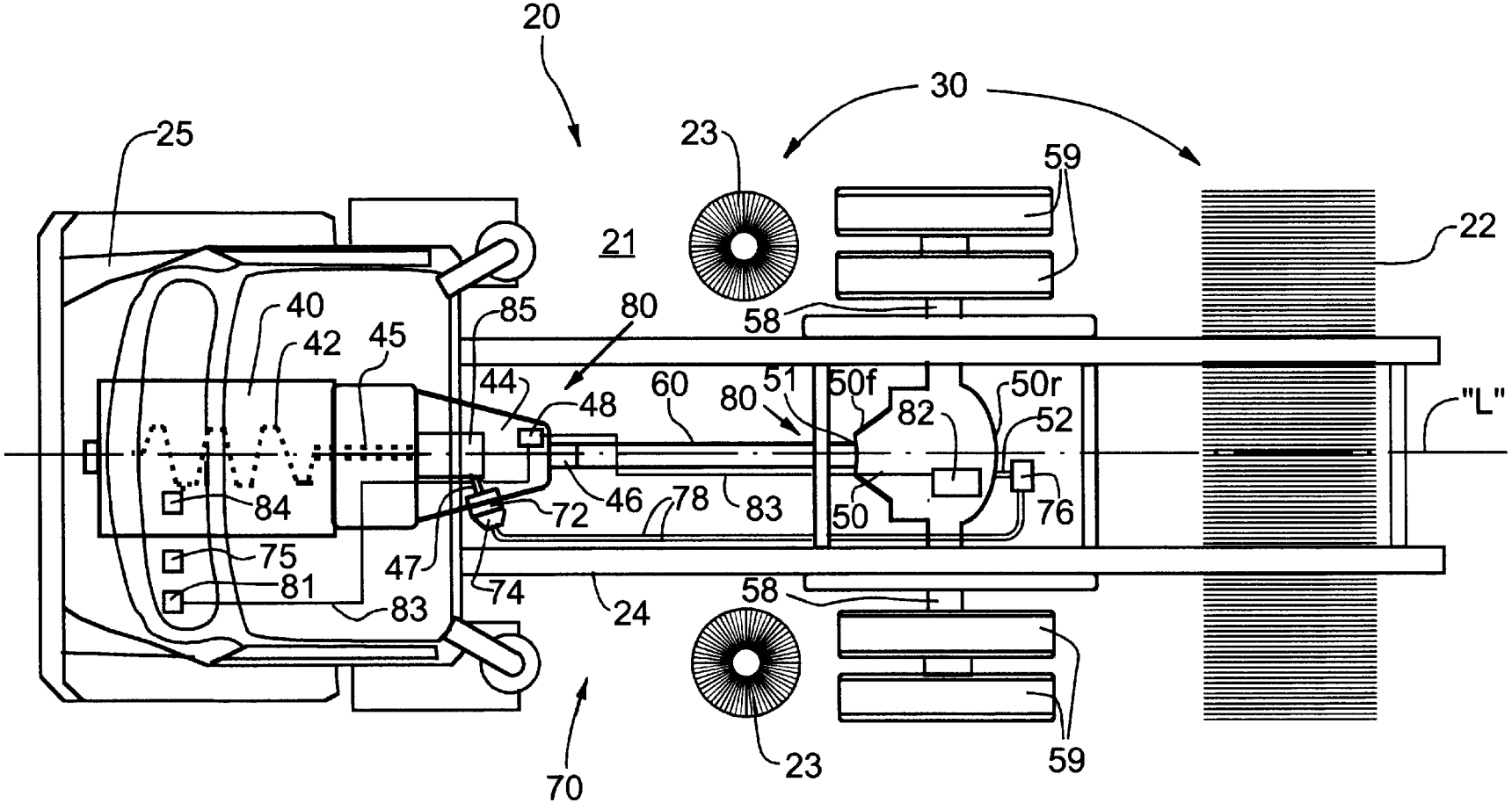
FIG. 1 is a top plan view of the preferred embodiment street cleaning vehicle according to the present invention, with details omitted for the sake of clarity.

Reference will now be made to FIGS. 1 through 5 of the drawings in which various embodiments of a street cleaning vehicle according to the present invention, and as indicated by the general reference numeral 20, is shown. While FIGS. 1 through 3 each depicts a preferred embodiment of the present invention, and FIGS. 4 and 5 each depict an alternative embodiment of the present invention, common and similar reference numerals are used in each of FIGS. 1 through 5 to denote like parts. It should be noted that the street cleaning vehicle 20 of the present invention is suitable for cleaning various surfaces such as streets, parking lots, airport tarmacs and runways, factory floors, and so on.

Figure 2:
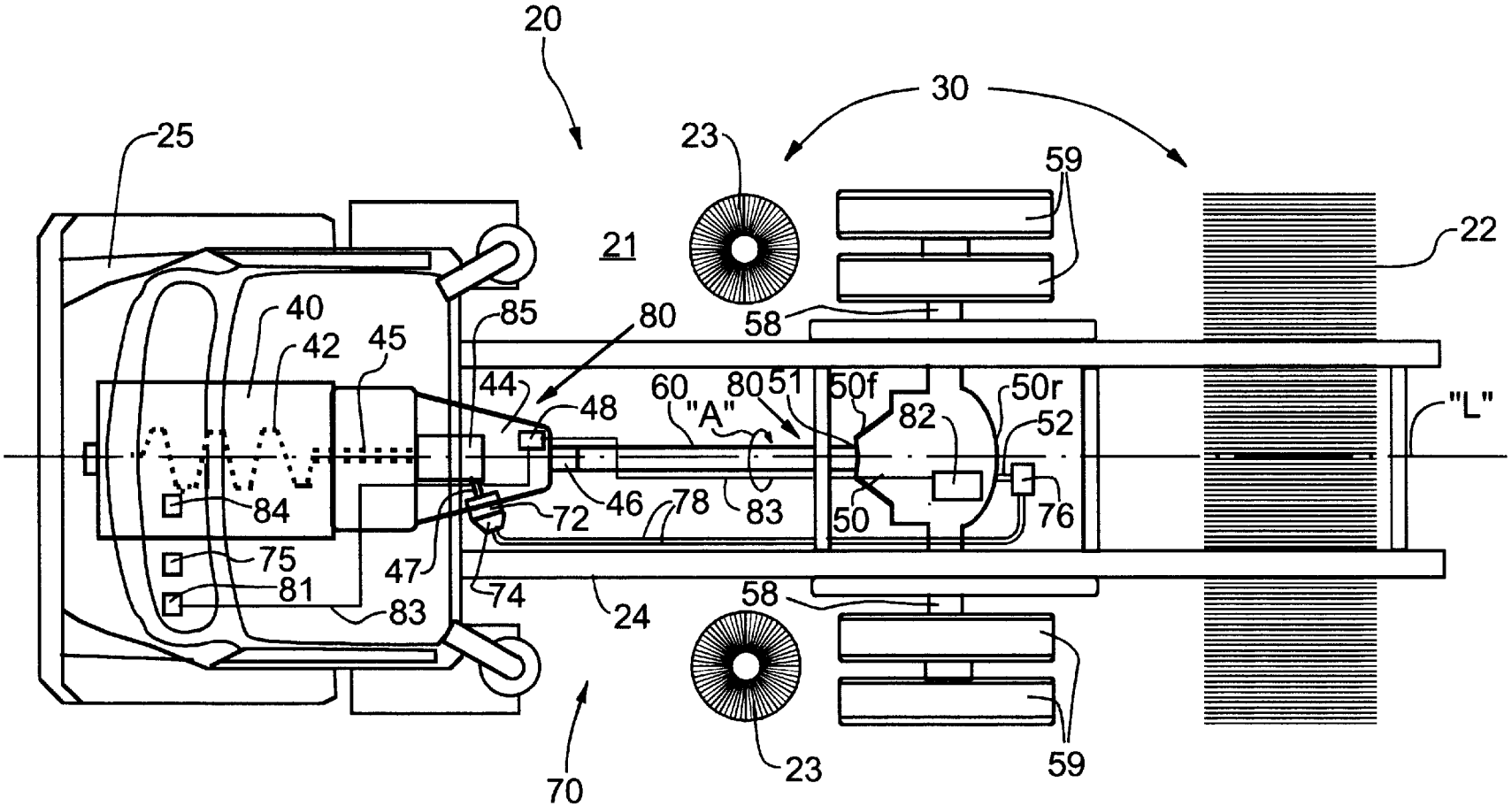
FIG. 2 is a top plan view similar to FIG. 1, with the driveshaft driving the differential and axle assembly.
Figure 3:
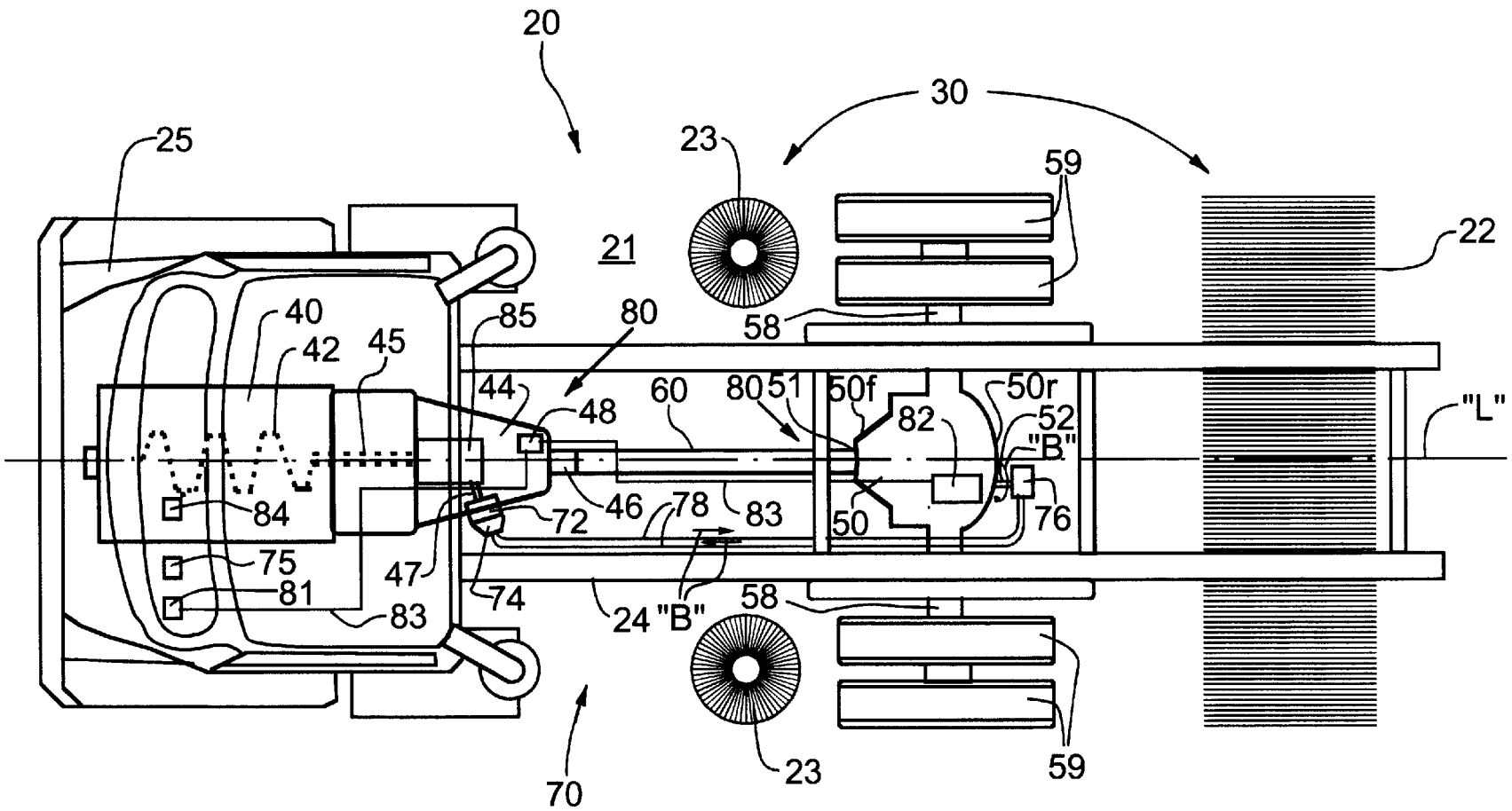
FIG. 3 is a top plan view similar to FIG. 3, but with the hydraulically powered motor driving the differential and axle assembly.

Reference will now be made to FIGS. 1 through 3, wherein the preferred embodiment of the street cleaning vehicle 20 according to the present invention is illustrated. The street cleaning vehicle 20 comprises a cab 25 and a street cleaning apparatus, as indicated by the general reference numeral 30. In the preferred embodiment, the street cleaning apparatus 30 comprises a sweeping brush 22 and two counter-rotating brushes 23 operatively mounted on the frame 24 of the street sweeping vehicle 20 in road tracking relation by means of suitable mounting arms (not shown) so as to permit the street sweeping vehicle 20 to follow a road surface 21. The sweeping brush 22 is disposed laterally across the longitudinal axis "L", preferably across most of the width of the street sweeping vehicle 20, and sweeps debris forwardly into an inclined elevator (not shown). The inclined elevator lifts dirt and debris into a hopper (not shown) for subsequent controlled dumping from the hopper. The above described the street cleaning apparatus 30 is well known in the industry.

Alternatively, the street cleaning apparatus 20 could comprise a vacuum air type system or a regenerative air type system (not shown), as are also well known in the industry.

In the preferred embodiment as illustrated, an engine for propelling the street cleaning vehicle 20 and for powering the street cleaning apparatus 30 preferably comprises a single internal combustion engine 40 having a mechanical power output, which comprises a crankshaft 42. While it is illustrated that power is taken off the crankshaft 42 behind the engine 40, it is also contemplated that power could be taken off the crankshaft 42 of the single internal combustion engine 40 in front of the engine 40.

A transmission 44 having an input shaft 45 and a primary output shaft 46 is connected in driven relation to the crankshaft 42 of the single internal combustion engine 40. In the preferred embodiment, as illustrated, the transmission 44 is a continual live transmission with 1:1 takeoff. In other words, the input shaft 45 of the transmission 44 drives an auxiliary live output shaft 47 that is always rotated by the engine 40, even when the transmission 44 is in neutral. As such, a power take-off unit appropriately mounted on the transmission 44 can be driven by the input 45 of the transmission 44, through the auxiliary live output 47, when the transmission 44 is in neutral.

In the preferred embodiment as illustrated in FIGS. 1 through 3, a differential and axle assembly 50 comprises a rear differential and axle assembly mounted on the street cleaning vehicle adjacent the back end thereof. The rear differential and axle assembly 50 includes a pair of rear drive axles 58 that drive rear wheels 59. Alternatively, the differential and axle assembly could be a front differential and axle assembly mounted on the street cleaning vehicle adjacent the front end thereof (not illustrated). In this case, the street cleaning vehicle would be a front wheel drive type vehicle, the first input shaft could be disposed at the rear of the differential and axle assembly and the second input shaft could be disposed at the front of the differential and axle assembly. Other configurations and arrangements of the first and second drive inputs are also contemplated and within the scope of this invention.

Figure 4:
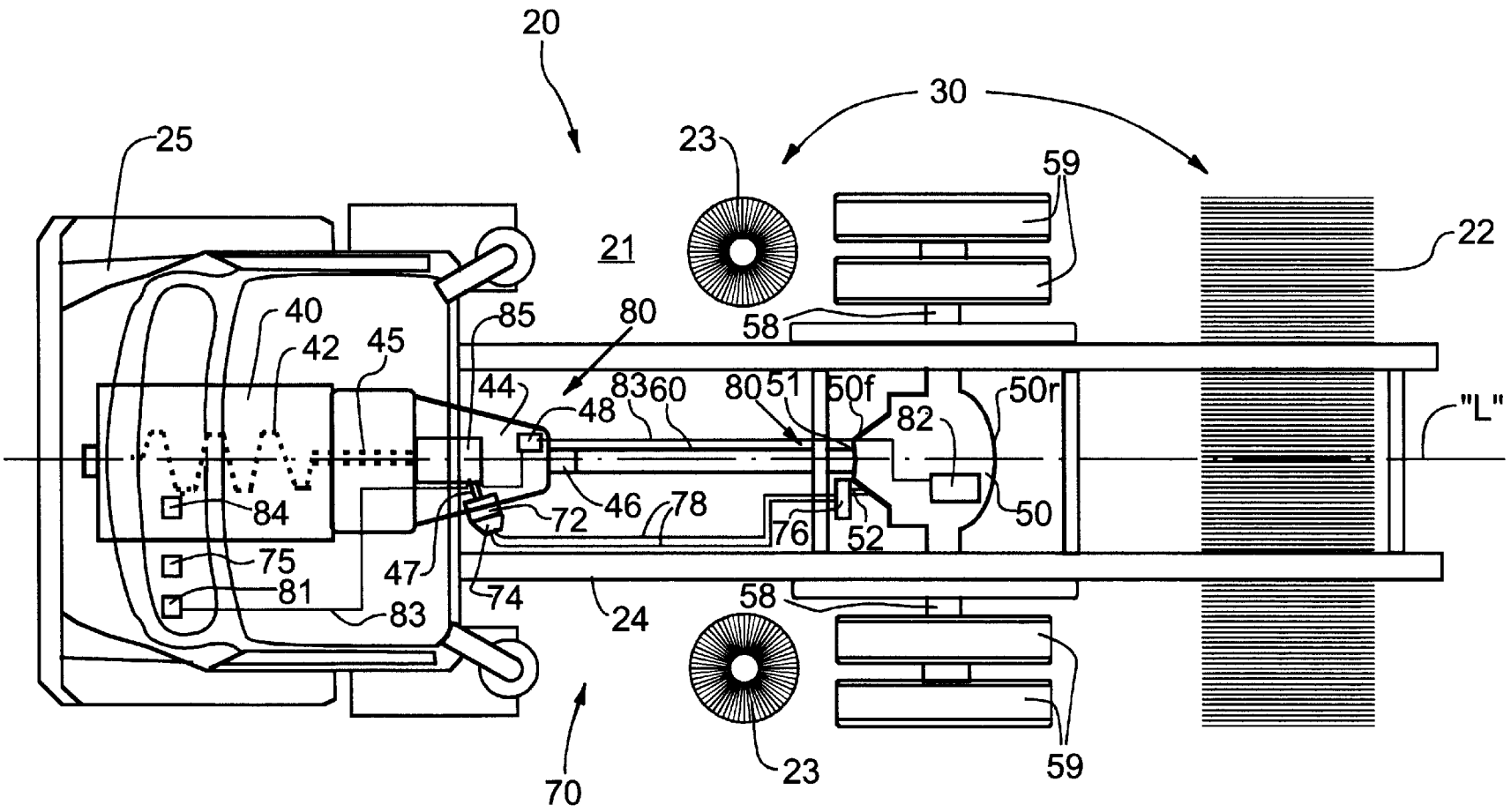
FIG. 4 is a top plan view of a first alternative embodiment of the street cleaning vehicle according to the present invention, with details omitted for the sake of clarity, wherein the first and second drive inputs are both disposed at the front end of the rear differential and axle assembly.

The rear differential and axle assembly 50 also comprises a first drive input in the form of a first input shaft 51 disposed at the front 50*f* of the differential and axle assembly 50 and a second drive input in the form of a second input shaft 52 disposed at the rear 50*r* of the differential and axle assembly 50, as can be best seen in FIGS. 1 through 3. Equivalently, in a first alternative embodiment, as is shown in FIG. 4, the first drive input, namely first input shaft 51, and the second drive input, namely first input shaft 52, are each disposed at the front 50*f* of the rear differential and axle assembly 50.

In the preferred embodiment as illustrated in FIGS. 1 through 3, the drive axles 58 and the rear wheels 59 are drivable by a selected one of the first input shaft 51 and the second input shaft 52, as will now be discussed in detail.

The first drive input, namely the first input shaft 51, is drivable in a first phase by the crankshaft 42 of the single internal combustion engine 40, through a mechanical coupling means comprising a driveshaft 60 that is connected in driven relation to the primary output shaft 46 of the transmission 44 and also connected in driving relation to the first input shaft 51 of the rear differential and axle assembly 50. The driveshaft 60 is indicated to be rotating by arrow "A" in FIG. 2. Accordingly, the rear wheels 59 of the street cleaning vehicle 20 may be driven directly by the single internal combustion engine 40 through the transmission 44 and driveshaft 60. Driving of the rear wheels 59 in the manner described immediately above is done for the purpose of driving the street cleaning vehicle 20 when the cleaning function is not being performed, or in other words, between job sites.

The second drive input, namely the second input shaft 52, is drivable in a second phase by a mechanical coupling means comprises a hydraulic power means, as indicated by the general reference numeral 70. The hydraulic power means 70 comprises a power take-off unit 72 operatively mounted on the transmission 44 so as to be connected in driven relation to the auxiliary live output 47 of the transmission 44. A variable displacement hydraulic pump 74 is connected in driven relation to the power take-off unit 72, and is controllable by an operator manipulated controller 75 located in the cab 25. A hydraulic drive motor 76 is connected in hydraulically powered relation to the variable displacement hydraulic pump 74 by suitable hydraulic hoses 78. Arrows "B" in FIG. 3 indicate the flow of hydraulic fluid.

Figure 5:
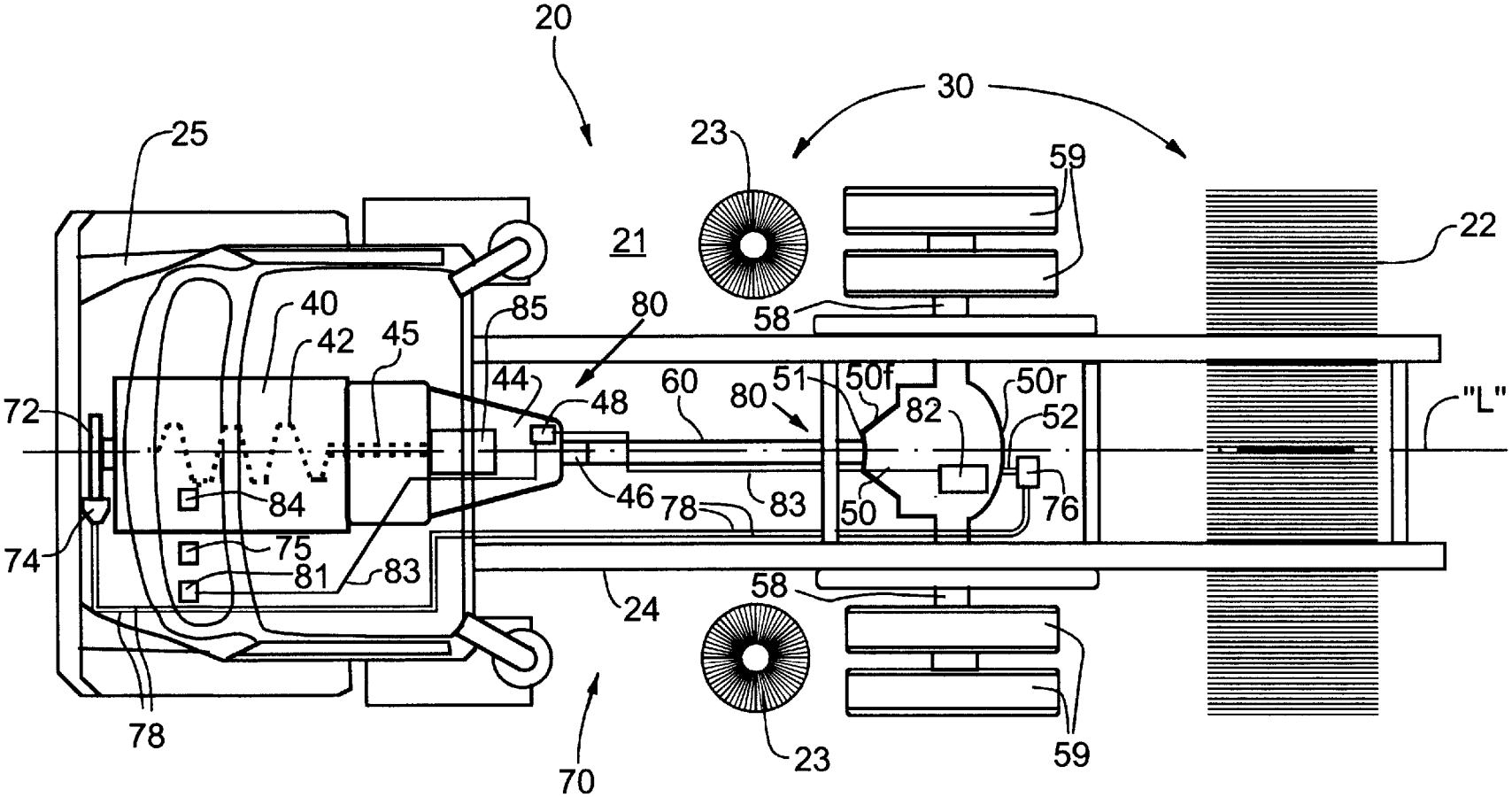
FIG. 5 is a top plan view of a second alternative embodiment of the street cleaning vehicle according to the present invention, with details omitted for the sake of clarity, wherein the power take-off unit is connected to the crankshaft of the vehicle's engine at the front of the vehicle.

Further, the hydraulic drive motor 76 is connected in driving relation to the second input shaft 52 of the differential and axle assembly 50. Accordingly, the rear wheels 59 of the street cleaning vehicle 20 may alternatively be driven by the single internal combustion engine 40 through the power take-off unit 72, the variable displacement hydraulic pump 74, and the hydraulic drive motor 76, as controlled by variable displacement hydraulic pump 74. Arrow "C" in FIG. 3 indicates the rotation of the second input shaft 52 of the differential and axle assembly 50. Alternatively, the hydraulic power means 70 could comprise a power take-off unit 72 connected in driven relation to the crankshaft 42 of the single internal combustion engine 40, at the front of the engine 40, as is illustrated in FIG. 5, if desired.

Driving of the rear wheels 59 in the manner described immediately above is done for the purpose of driving the street cleaning vehicle 20 during the cleaning function, so as to permit the street cleaning vehicle 20 to be driven in a fully controlled manner at any selected speed between zero and the maximum rate of travel possible with the particular hydraulic power means 70, without riding the vehicle's brakes, and further permits the speed of the engine 40 to be maintained at a desired setting to power the street cleaning apparatus 30.

It should be noted that although the vehicle's brakes are not used to control the speed of the street cleaning vehicle 20 during the cleaning function, the vehicle's brakes are used to stop the vehicle. An electric or pneumatic switching system having a switch (not shown) mounted so as to be operated upon depression of the brake pedal, moves the swash plate (not specifically shown) within the variable displacement hydraulic pump 74 to essentially stop the hydraulic pump 74 from pumping. Accordingly, the hydraulic power means 70 is not trying to propel the street cleaning vehicle 20 when it is being stopped.

A selectably operable switching means, as indicated by the general reference numeral 80, is used to effect a selected one of the first phase, wherein the first input shaft 51 of the rear differential and axle assembly 50 is drivable by the driveshaft 60, as can be best seen in FIG. 2, and the second phase, wherein the second input shaft 52 of the rear differential and axle assembly 50 is drivable by the hydraulic power means 70, as can be best seen in FIG. 3. In either case, the driven one of the first input shaft 51 and the second input shaft 52 drives the rear wheels 59 through the drive axles 58, so as to propel the street cleaning vehicle 20. In the preferred embodiment, the selectably operable switching means 80 comprises a transmission shift mechanism 81 and a differential lock 82.

The transmission shift mechanism 85 is housed integrally within the transmission 44 so as to be operatively connected to the transmission 44, and also continues into the cab 25 in the form of a control lever 84. The transmission shift mechanism 85 is selectably operable, typically by the driver of the street cleaning vehicle 20, through manipulation of the control lever 84. The specific arrangement and mechanics of the transmission shift mechanism 85 and the control lever 84 depends on whether the transmission 44 is an automatic transmission or a manual transmission, among other factors.

The transmission shift mechanism 85, as controlled by the control lever 84, is used to effect the aforesaid first phase, wherein the transmission 44 is engaged, or in other words, not in neutral, the street cleaning vehicle 20 is propelled by the single internal combustion engine 40 through the transmission 44, the driveshaft 60, the first input shaft 51 of the rear differential and axle assembly 50, the rear drive axles 58, and the rear wheels 59.

The differential lock 82 is preferably internally mounted within the differential and axle assembly 50 so as to be operatively connected to the rear differential and axle assembly 50, and is selectably operable through manipulation of the control handle 81 in the cab 25 of the street cleaning vehicle 20, typically by the driver of the street cleaning vehicle 20. The control handle 81 may be in any suitable form, such as a pushbutton or lever, and is electrically connected to the differential lock 82 by wires 83 through a lock-out switch 48 that is integrally mounted within the transmission 44.

The differential lock 82, as controlled by the control handle 81, is used to effect the aforesaid second phase, wherein the street cleaning vehicle 20 is propelled by the single internal combustion engine 40 through the power take-off unit 72, the variable displacement hydraulic pump 74, and the hydraulic drive motor 76, the second input shaft 52 of the rear differential and axle assembly 50, the rear drive axles 58, and the rear wheels 59.

In order to prevent severe damage to the rear differential and axle assembly 50 or other components, it is extremely preferable, and almost essential, to drive the rear differential and axle assembly 50 through only one of the first input shaft 51 and the second input shaft 52—or in other words through either the transmission 44 and the driveshaft 60, or alternatively through the power take-off unit 72, the variable displacement hydraulic pump 74, and the hydraulic drive motor 76. In order to preclude driving of the rear differential and axle assembly 50 concurrently through both of the first input shaft 51 and the second input shaft 52, the lock-out switch 48 that is integrally mounted within the transmission 44 and is electrically connected to the differential lock 82, detects whether the transmission 44 is in gear—or in other words, in driving mode—or in neutral. The lock-out switch 48 is electrically open when the transmission 44 is in gear and is electrically closed when the transmission 44 is in neutral. Therefore, if the transmission 44 is in gear, the lock-out switch 48 prevents the control handle 81 from effecting engagement of the differential lock 82. Accordingly, the differential lock 82 cannot effect the aforesaid second phase, wherein the rear differential and axle assembly 50 is drivable through the second input shaft 52 by the hydraulic power means 70.

When the transmission 44 is in neutral, the lock-out switch 48 permits the control handle 81 to effect engagement of the differential lock 82. Accordingly, the differential lock 82 effects the aforesaid second phase, wherein the rear differential and axle assembly 50 is drivable through the second input shaft 52 by the hydraulic power means 70.

Further, during driving of the street cleaning vehicle 20 through the hydraulic power means 70 and the second input shaft 52, and in the event that the transmission 44 is shifted into gear—or in other words is shifted out of neutral—thus selecting driving engagement of the drive axles 58 with the engine 50 through the first input shaft 51, the lock-out switch 48 immediately causes the differential lock 82 to effect disengagement of the drive axles 58 with the second input shaft 52, and thus ultimately with the single internal combustion engine 40, as the second input shaft 52 is then the non-selected input.

Other variations of the above principles will be apparent to those who are knowledgeable in the field of the invention, and such variations are considered to be within the scope of the present invention. Further, other modifications and alterations may be used in the design and manufacture of the drag shoe of the present invention without departing from the spirit and scope of the accompanying claims.

I claim:

1. A street cleaning vehicle comprising:

an engine having a mechanical power output;

a differential and axle assembly having a first drive input drivable in a first phase by said mechanical power output of said engine through a mechanical coupling means and a second drive input drivable in a second phase by said mechanical power output of said engine through a hydraulic power means, and drive axles drivable by a selected one of said first drive input and said second drive input, so as to propel said street cleaning vehicle;

selectably operable switching means to effect a selected one of said first and second phases.

2. The street cleaning vehicle of claim 1, wherein said engine comprises a single internal combustion engine.

3. The street cleaning vehicle of claim 2, wherein said mechanical power output comprises an engine crankshaft.

4. The street cleaning vehicle of claim 3, wherein said mechanical coupling means comprises a transmission connected in driven relation to said mechanical power output of said engine, and a driveshaft connected in driven relation to said transmission and connected in driving relation to said first input of said differential and axle assembly.

5. The street cleaning vehicle of claim 4, wherein said selectably operable switching means comprises a transmission shift mechanism operatively connected to said transmission and a differential lock operatively connected to said differential and axle assembly.

6. The street cleaning vehicle of claim 5, wherein said differential lock is internally mounted within said differential and axle assembly.

7. The street cleaning vehicle of claim 6, wherein said hydraulic power means comprises a power take-off unit connected in driven relation to said transmission, a variable displacement hydraulic pump connected in driven relation to said power take-off unit, and a hydraulic drive motor connected in hydraulically powered relation to said variable displacement hydraulic pump and connected in driving relation to said second drive input of said differential and axle as assembly.

8. The street cleaning vehicle of claim 7, further comprising lock-out means operatively disposed in said transmission, which lock-out means precludes said differential lock from engaging said second drive input and said drive axles unless said transmission is shifted into neutral.

9. The street cleaning vehicle of claim 8, wherein said lock-out means comprises a neutral lock-out switch.

10. The street cleaning vehicle of claim 1, wherein one of said first and second drive inputs is disposed at the front of said differential and axle assembly and the other of said first and second drive inputs is disposed at the rear of said differential and axle assembly.

11. The street cleaning vehicle of claim 10, wherein said differential and axle assembly comprises a rear differential and axle assembly.

12. The street cleaning vehicle of claim 11, wherein said first drive input is disposed at the front of said differential and axle assembly and said second drive input is disposed at the rear of said differential and axle assembly.

13. The street cleaning vehicle of claim 11, wherein said first drive input and said second drive input are each disposed at the front of said differential and axle assembly.

* * * * *